US005125150A

United States Patent [19]

Meyer

[11] Patent Number: 5,125,150

[45] Date of Patent: Jun. 30, 1992

[54] TOOL FOR MASS TERMINATING WIRES TO ELECTRICAL CONNECTORS

[75] Inventor: David L. Meyer, Jonestown, Pa.

[73] Assignee: AMP Incorporated, Harrisburg, Pa.

[21] Appl. No.: 753,576

[22] Filed: Sep. 3, 1991

[51] Int. Cl.[5] ..... H01R 43/04

[52] U.S. Cl. ..... 29/566.3; 29/749; 29/753

[58] Field of Search ..... 29/749, 753, 566.3, 29/566.4, 751

[56] References Cited

U.S. PATENT DOCUMENTS 3,758,935 9/1973 Long et al. ..... 29/203 MW 4,781,615 11/1988 Davis et al. ..... 439/395

*Primary Examiner*—Carl E. Hall

*Attorney, Agent, or Firm*—David L. Smith

[57] ABSTRACT

There is described,a tool (2) for cooperation with wire insertion fingers (37), for terminating electrical wires (W) to wire receiving contacts (8) which project from two opposite sides of an electrical connector (4). The tool (2) comprises a wire comb holder (46) in which are pivotally mounted two parallel wire combs (48). The wire combs (48) having a wire receiving angular position in which wire slots (96) of the combs (48) open way from the comb holder (46), in which position wires (W) are laced into the wire slots (96), and a wire terminating position in which the wire slots (96) of the two combs (48) open towards each other. A connector holder (52) pivoted to one end of the comb holder (46) and containing a connector (4) is moved to a closed position, in the terminating position of the wire combs (48), to insert the contacts (8) of the connector (4) between the teeth of the combs (48). A press (22) is used to drive the insertion fingers (37) through the combs (48) to terminate wires (W) in the combs (48) to the contacts (8) of the connector (4).

20 Claims, 14 Drawing Sheets

TOOL FOR MASS TERMINATING WIRES TO ELECTRICAL CONNECTORS

BACKGROUND OF THE INVENTION

This invention relates to a tool for cooperation with wire insertion fingers for terminating electrical wires to wire receiving contacts projecting in at least one row from each of two opposite sides of an electrical connector.

BACKGROUND OF THE INVENTION

There is disclosed in U.S. Pat. No. 3,758,935 a manual tool for mass terminating wires to wire receiving contacts projecting from opposite sides of an electrical connector. The tool comprises a first jig for holding the connector in a predetermined position and a second jig for locating the wires in predetermined positions. A wire inserting member is moved to past the second holding jig and towards the first holding jig to transfer the wires from the second jig to the contacts of the connector. An edge of the wire inserting member acts as a shear edge for trimming the ends of the wires as they are being transferred from the second jig to the connector. One end of the second jig and one end of the wire inserting member are pivoted to the first jig. In order to terminate wires to the contacts on both sides of the connector simultaneously, one end of a further second jig and one end of a further wire inserting member is pivoted to the first holding jig.

U.S. Pat. No. 4,781,615 discloses an electrical connector comprising a housing containing two rows of electrical terminals, each having a slotted insulation displacement plate contact seated on a terminal support block projecting rearwardly from the housing. The contacts of the terminals of one row project from one side of the support block and those of the other row project from the opposite side of the support block. Before terminating respective groups of wires to the contacts on each side of the support block, the wires of each group are secured together by means of an adhesive strip or by bonding, with the ends of the wires in coplanar relationship. In order to terminate the wires to the contacts, the ends of the wires of each group are positioned over the contacts on a respective side of the support block and a plastic terminating cover is pressed on to each side of the support block to stuff the wires into the contacts. The force applied to the covers must necessarily be limited in order to avoid damage thereto.

Patent Application Ser. No. 07/675,585 filed on Mar. 26, 1991 relates to a tool comprising a pivotable wire comb and a stationary wire comb. In use of the tool, the pivotable wire comb is moved to an open position with respect to the stationary wire comb and an electrical connector having slotted plate, insulation displacement contacts projecting from opposite sides of the connector is laid on the fixed comb and the pivotable comb is then pivoted to a closed position. Wires to be terminated to the contacts of the connector, are inserted through slots in the pivotable comb and through slots in the stationary comb. The tool is then laid on the base plate of a press, with one of the combs uppermost and the ram of the press is actuated to cause wire stuffer fingers on the ram to be inserted through the slots defined by said uppermost comb, to drive a wire into each of the contacts on that side of the connector which is uppermost. Orientation of the tool is then reversed so that said uppermost comb becomes the lowermost comb and the wires in the lowermost comb are terminated to the contacts on the opposite sides of the connector by means of the press. The combs can be wired according to two different modes. In one mode, one of the combs is first wired and the tool is turned over to expose the other comb which is then wired. In the other mode of wiring the combs, the tool is supported for lateral pivotable movement on a bench stand, with the combs extending vertically. The tool is rocked in one direction for the purposes of wiring one of the combs and in the opposite direction for wiring the other comb. For cross-row termination of the wires, the tool must be continually rocked on the bench stand and for in-row termination of the wires, the tool must be rocked after the first comb has been wired. In either case, the combs are so positioned with respect to the operator who is wiring them, that he must twist his neck during the wiring operations. The present invention is intended to provide a tool which does not have this disadvantage.

SUMMARY OF THE INVENTION

The invention provides a tool for cooperation with wire insertion means for terminating electrical wires to wire receiving contacts projecting in at least one row of each of two opposite sides of an electrical connector. The tool comprises an elongate wire comb holder and a pair or elongate wire combs having teeth defining wire receiving slots, arranged in parallel spaced relationship and being pivotally connected at their ends to the wire comb holder for angular movement between a comb wiring position in which the wire slots of the combs open in a direction away from the wire comb holder receive wires, and a wire terminating second position in which the wire slots of one comb open towards those of the other comb. The tool further comprises a connector holder for receiving the connector and being moveable with respect to the wire comb holder to insert the connector between the wire combs when the wire combs are in their wire terminating position, so as to align each contact of the connector with a respective one of the wire slots of the combs. The wire insertion means can then be inserted through each wire comb in succession, to terminate the wires therein to the corresponding contacts of the connector.

In the wiring angular position of the combs, the operator can readily insert the wires into the wire slots of the combs, either for cross-row termination or for in-row termination without having to move his head during the wiring operation.

Conveniently, the connector holder is pivotally attached to the wire comb holder and is angularly moveable between a position in which the connector holder does not obstruct the wiring of the combs and a position in which the contacts of the connector lie between the combs when they are in their wiring position, means being provided for latching the connector holder in the latter of these two positions. The wire comb holder is preferably provided with a cable clamp for securing a cable end portion thereto, and a wire access opening providing access to the combs for wires extending from the cable end portion secured in the wire clamp.

The connector holder may be adjustable to receive connectors of different length, and the wire clamp may be adjustable on the wire clamp holder, longitudinally of the wire combs.

DESCRIPTION OF THE PREFERRED EMBODIMENT

Figure 2:
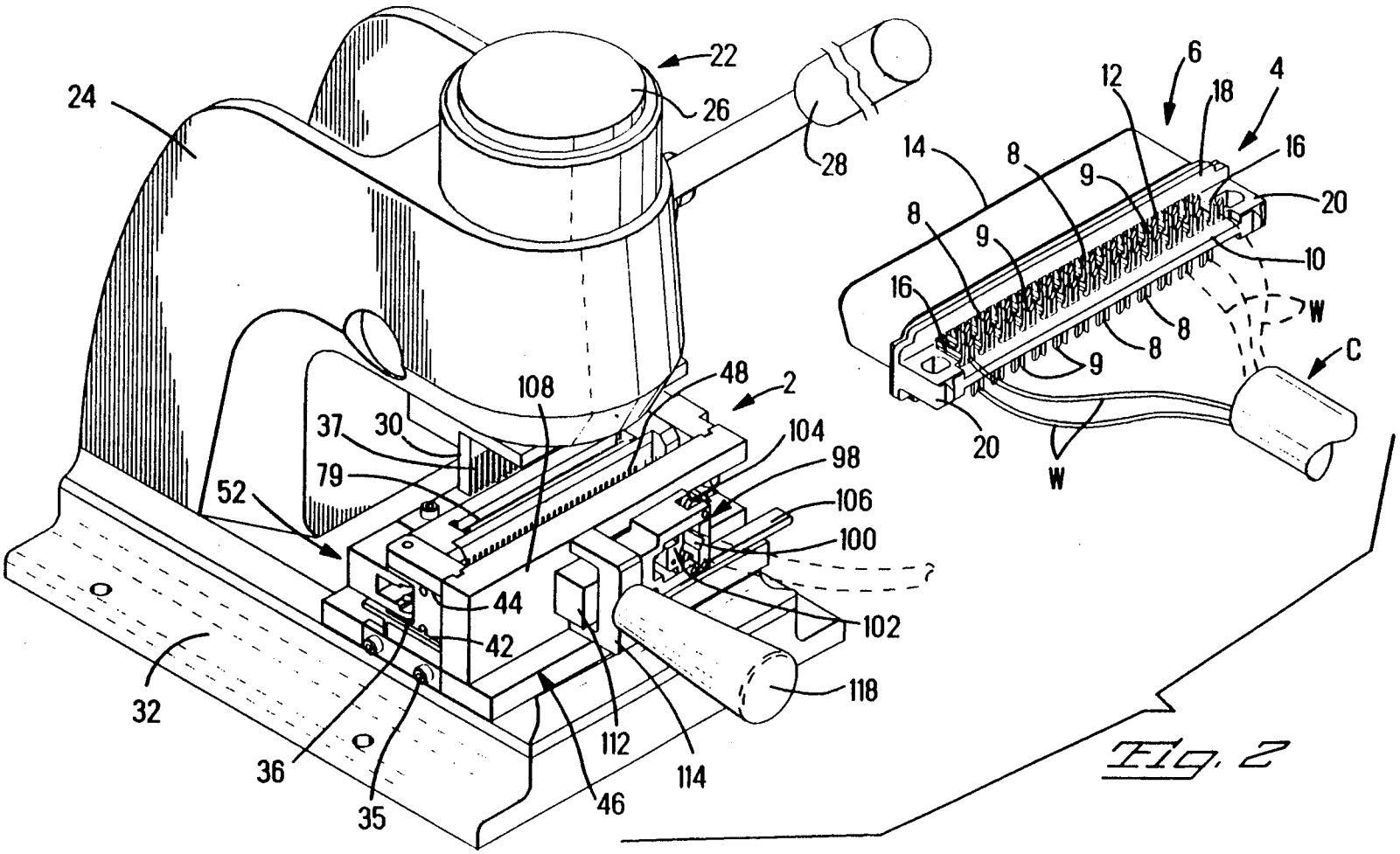
FIG. 2 is a similar view to that of FIG. 1 but showing the tool positioned on the mounting plate in a first orientation, and the connector (in an enlarged scale) exploded from the tool with the wires terminated to the contacts of the connector.

A mass terminating tool 2 according to the invention, is for terminating insulated wires W of a multi-wire cable C, to a multi-contact electrical connector 4 which may be substantially according to the teaching with U.S. Pat. No. 4,781,615 which is incorporated herein by reference. As best seen in FIG. 2, the connector 4 comprises an insulating housing 6 containing electrical terminals having insulation displacement slotted plate contacts 8 projecting from a support plate 10 extending rearwardly of the housing 6 beyond a terminal receiving face 12 of the housing 6. Each contact 8 has a wire receiving slot 9 opening away from the plate 10. The housing 6 defines internal cavities extending from the face 12 to an opposite mating face 14 and receiving mating portions (not shown) of the terminals. The contacts 8 project normally from each side of the support plate 10 in two rows, namely a forward row and a rear row, the contacts 8 of the forward row being offset longitudinally of the connector from those of the rear row and vice versa. Each contact 8 is connected to a corresponding one of said mating portions by way of a neck 16. The wire receiving face 12 is surrounded by a collar 18 and a mounting lug 20 projects from each end of the support plate 10.

Figure 1:
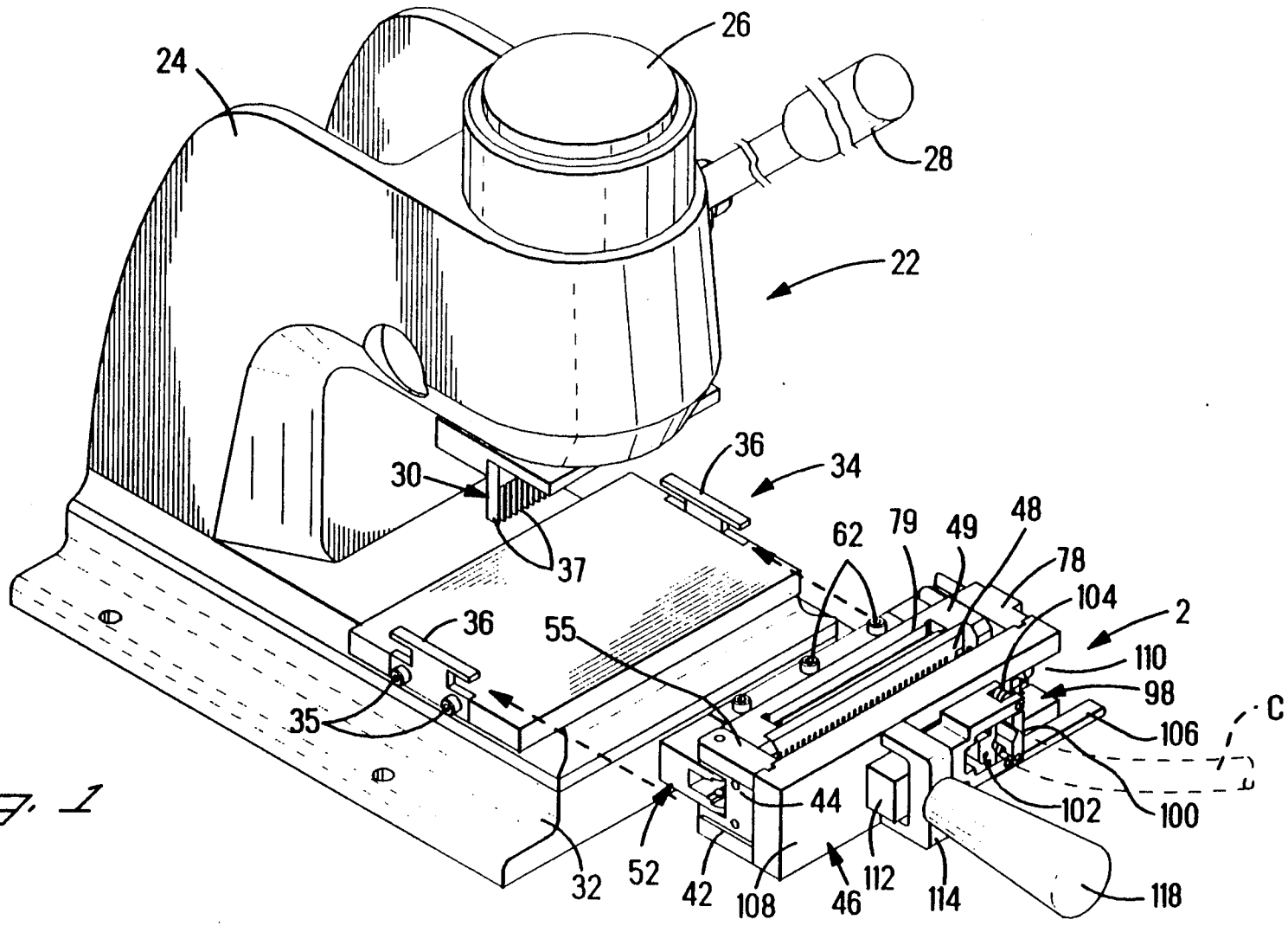
FIG. 1 is an isometric view showing an arbor press, and a tool according to the invention for mass terminating insulated wires to a multi-contact electrical connector comprising an insulating housing having a plurality rows of insulation displacement contacts, the tool being shown when it is about to be positioned on a mounting plate of the press.

As shown in FIGS. 1 and 2, a manually operated arbor press 22 comprises a press frame 24 in which a press ram 26 is vertically slideable by means of an operating lever 28. The lower end of the ram 26 carries upper press tooling in the form of a wire trimmer and stuffer plate 30. The frame 24 has a base 32 to which is fixed a mounting plate 34 for the terminating tool 2. At each end thereof of the plate 34 is secured, by means of fasteners 35, a T shaped tool mounting rail 36. The plate 30 comprises, as will appear from FIGS. 8 to 10 and 12, a row of wear stuffer fingers 37 each comprising three juxtaposed stuffer members 38, 39 and 41 defining between them two stuffing recesses 40 each for receiving a respective one of two adjacent forward and rear contacts 8 of the connector 4. The stuffer member 41 also acts as a wire shear member, as will be described below, and thus has a shearing edge 43, this being the outer edge of the member 41. At each end thereof, the tool 2 defines two superposed channels 42 and 44, respectively, each for receiving one of the rails 36. The tool 2 can thus be mounted to the plate 34 of the press 22 and either of two opposite orientations, so that the contacts 8 of each side of the support plate 10 can be wired, as will be described in detail below.

Figure 6:
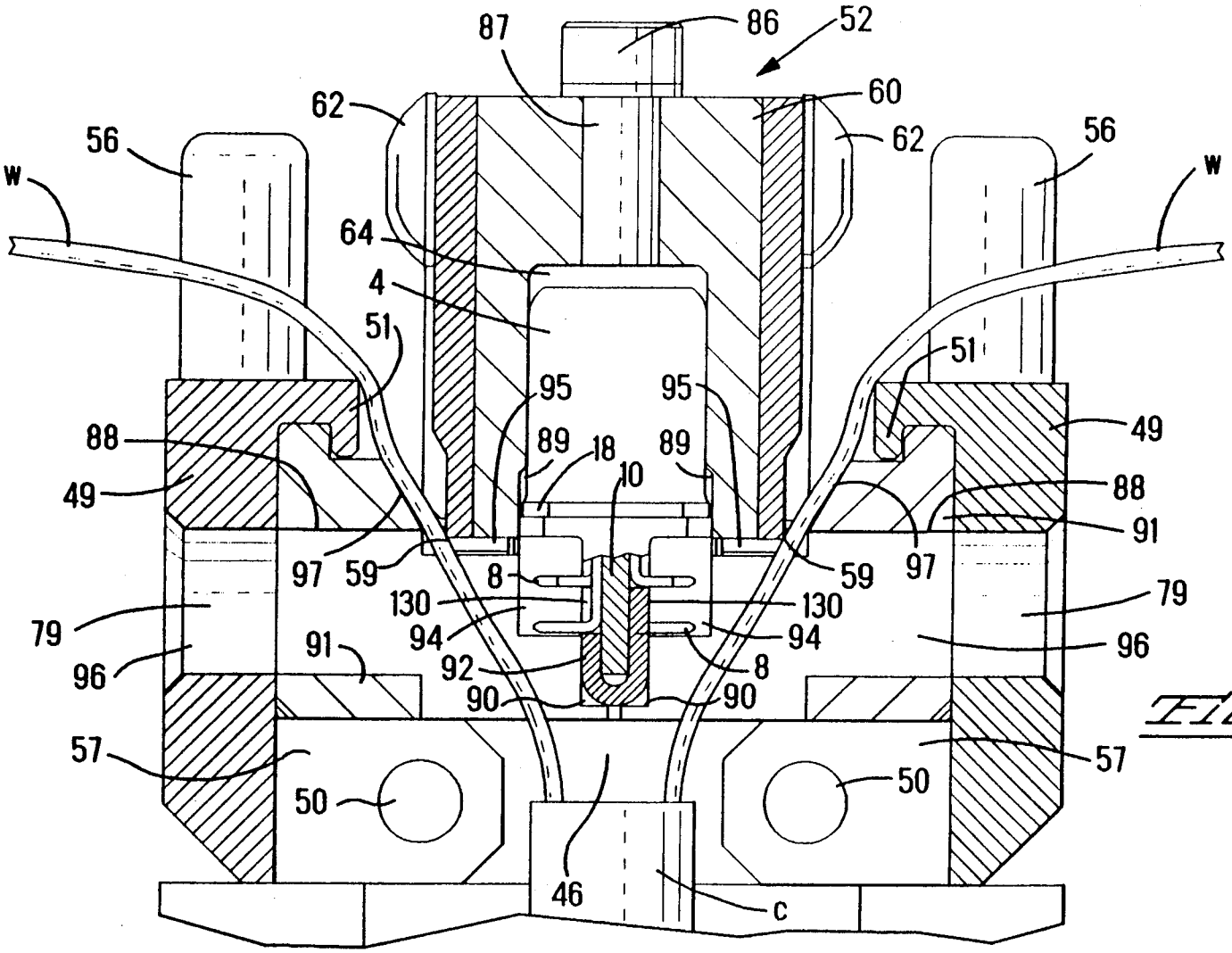
FIG. 6 is a view taken on the lines 6—6 of FIG. 4.
Figure 7:
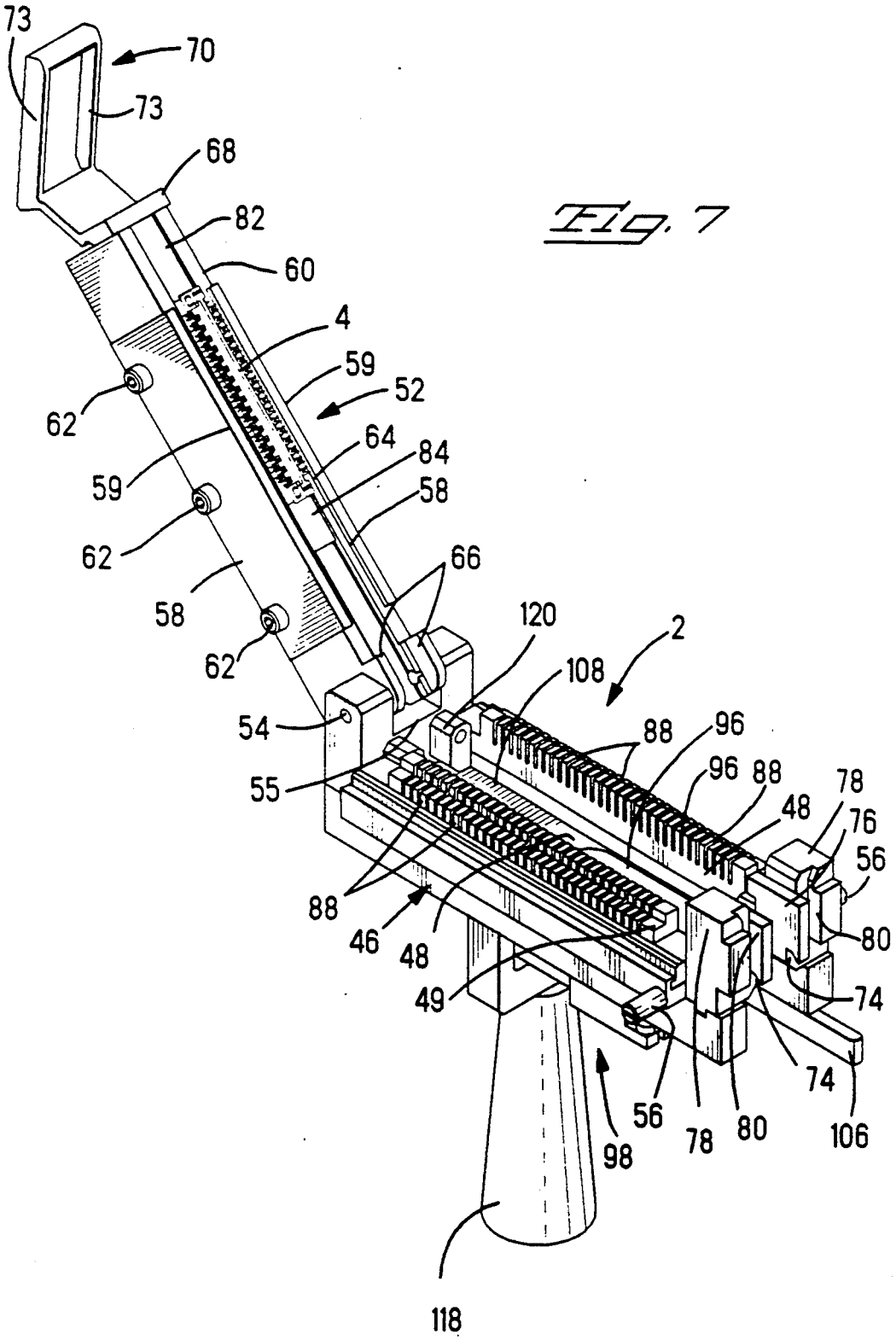
FIG. 7 is an isometric view of the terminating tool with the combs and the connector holder in their open positions and the connector located in the connector holder.

As best seen in FIG. 7, the mass terminating tool 2 basically comprises, an elongate wire comb holder 46, a pair of parallel wire combs 48 in the comb holder 46, and an elongate connector holder 52. Each comb 48 is exchangeably mounted in a comb carrier 49, by means of flanges 51 thereon, which comb carrier is rotatable on pivot pins 50 (FIGS. 5 and 6, and 8 to 10) supported in lugs 57 of the holder 46, whereby the combs 48 are rotatable about their longitudinal axes between an open, wiring position and a closed wire terminating position. The connector holder 52 is pivoted at one end thereof, on pivot pins 54 in a clevis 55 at one end of the comb holder 46. A handle 56 is provided on each comb carrier 49 for manually rotating the combs 48 between their open and their closed positions. The connector holder 52 comprises a pair of shear plates 58 each having a longitudinally extending outer shear edge 59. The plates 58 are exchangeably secured to opposite sides of an elongate central block 60 of the holder 52 by means of fasteners 62. The block 60 defines a central longitudinal, connector receiving channel 64 and has at its end adjacent to the comb holder 46, a pair of lugs 66 receiving the pivot pins 54. At its end remote from the comb holder 46, the connector holder 52 has an end wall 68 from which projects a stirrup-shaped latch arm 70 having side arms 73 bridged by a cross bar 72. The bar 72 is latchingly engageable in end notches 74 in parallel plates 76 on blocks 78 at the end of the comb holder 46 remote from the clevis 55. In the latched down position of the connector holder 52, the arms 73 are received in respective slots 80 each defined between a respective plate 76 and the adjacent block 78. Each comb carrier 49 has a longitudinal access slot 79 for receiving the fingers 37 of the plate 30, the combs 38 being formed with slots 81 each for receiving a respective one of the fingers 37 of the plate 30. The pivot pins 50 project from the clevis 55 and the blocks 78.

Figure 10:
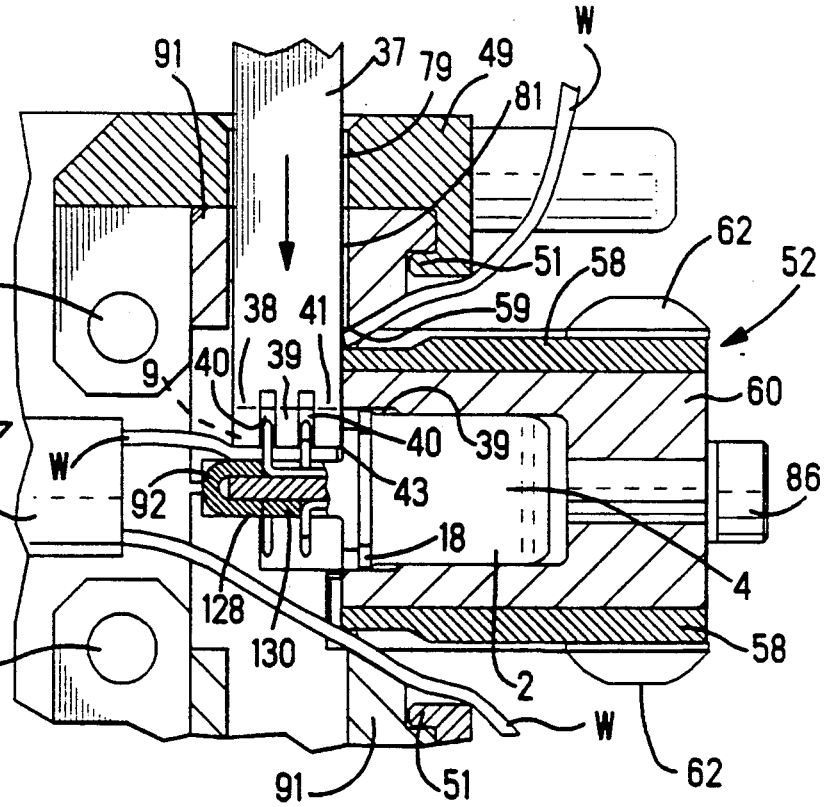
FIG. 10 is a similar view to that of FIG. 9 but showing the wire trimmer and stuffer plate after terminating the wires to contacts on one side of the connector.
Figure 11:
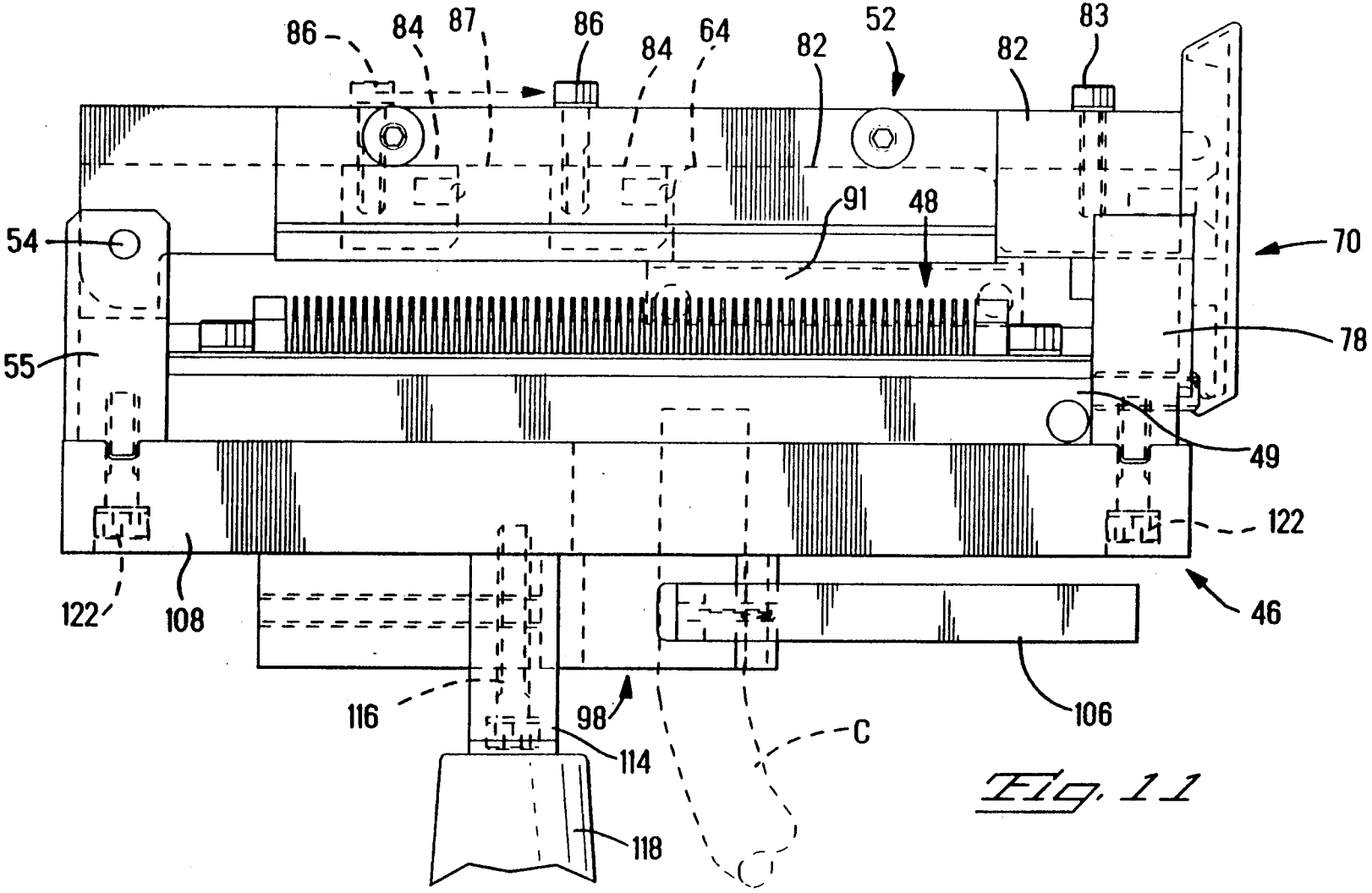
FIG. 11 is a side view of the terminating tool.
Figure 12:
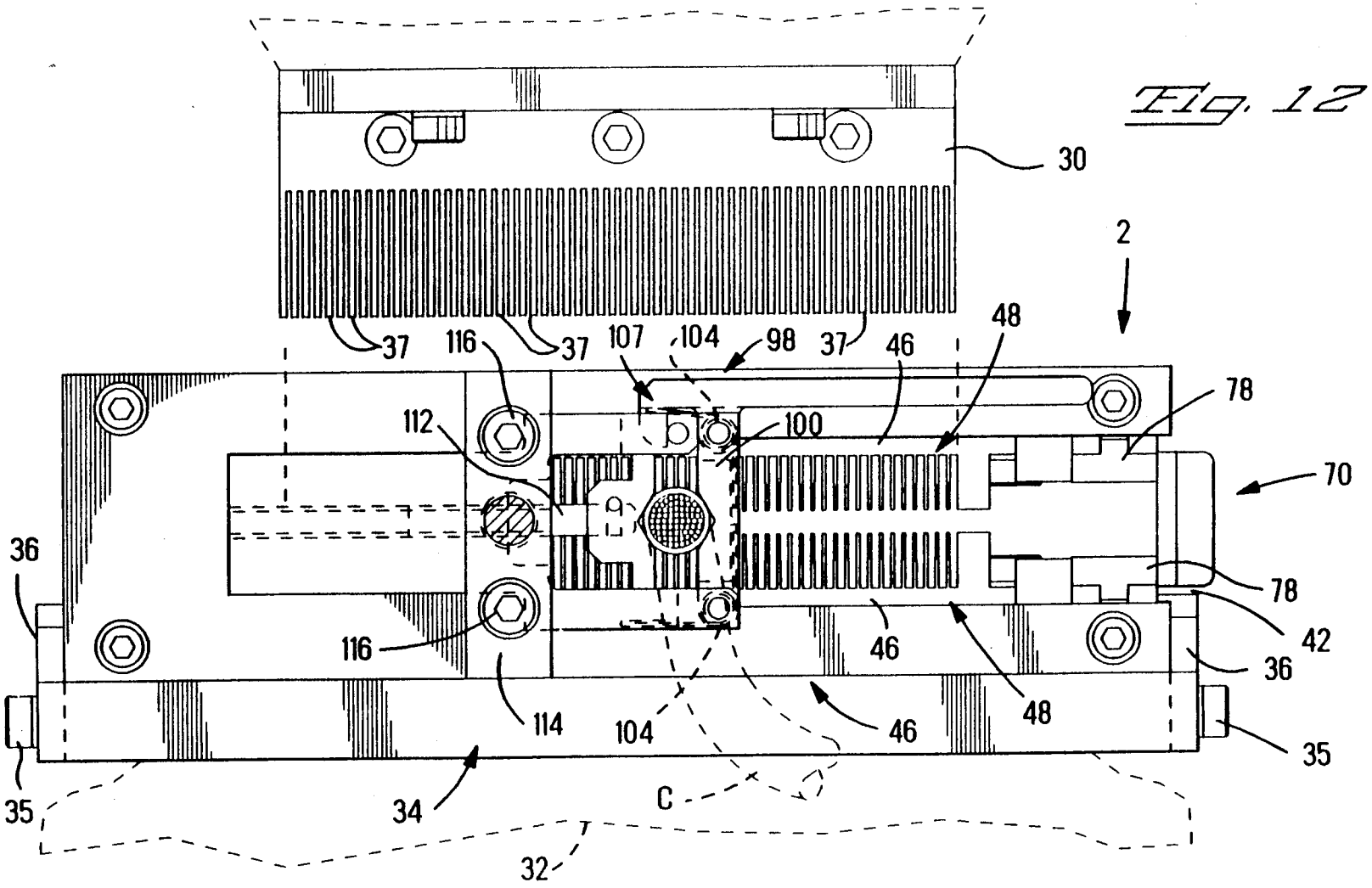
FIG. 12 is a diagrammatic front view of the terminating tool when disposed on the mounting plate of the press in a second orientation opposite to said first orientation.
Figure 14:
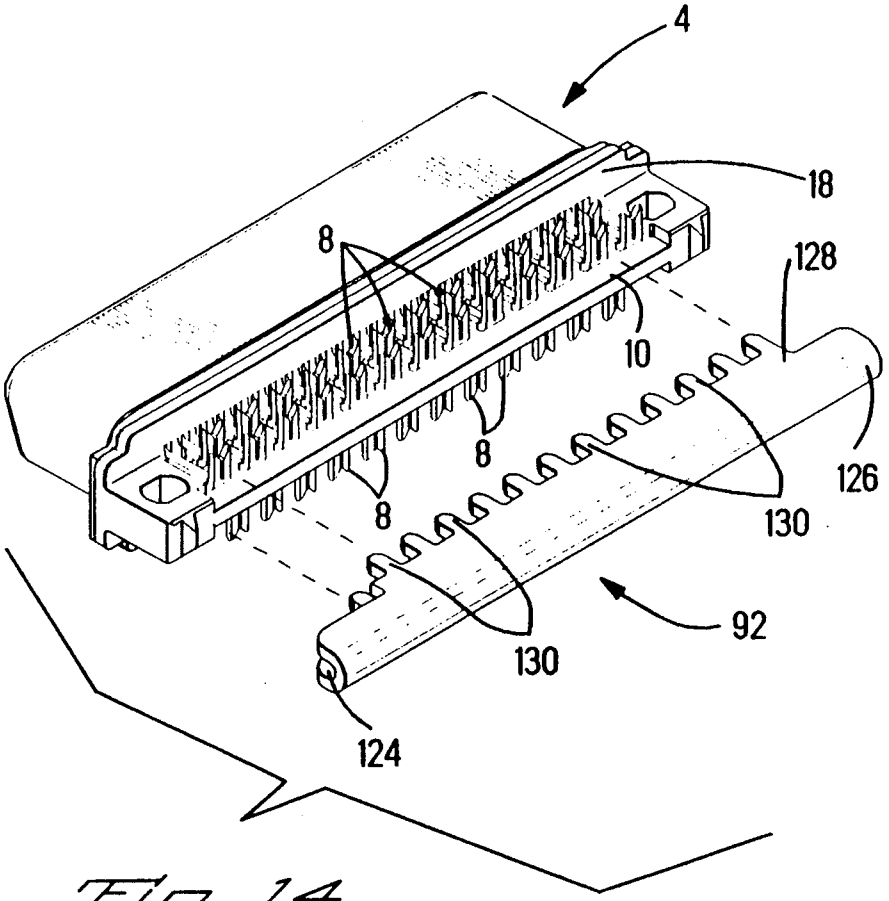
FIG. 14 is an exploded isometric view illustrating the manner in which the termination bar is assembled to the connector.
Figure 13:
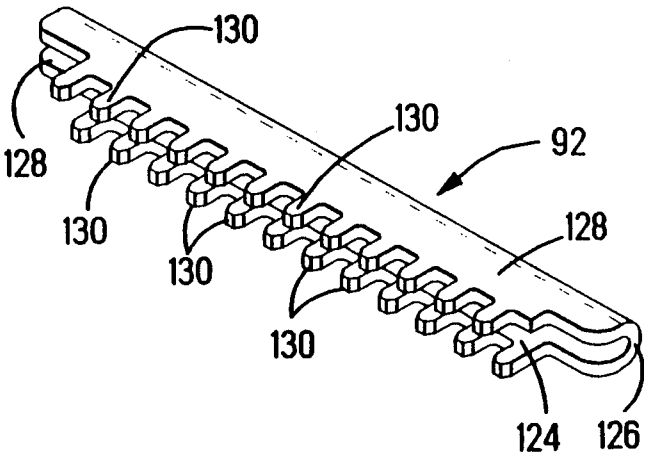
FIG. 13 is an isometric view of a termination bar for reinforcing the contacts of the connector as the wires are being terminated thereto.

The connector holder 52 comprises, in the channel 64, a stationary connector holder block 82 secured to the holder 52 by means of a fastener 83, and an adjustable connector holder block 84 which is shown in tow positions of adjustment in FIG. 11. The block 84 is slideable along the channel 64 to an extend commensurate with the length of the connector 4 to be accommodated in the channel 64 and can be fixed in its final position of adjustment by means of a lock screw 86. The screw 86 is slideable along a slot 87 in the block 60 of the connector holder 52 before being tightened to secure the block 84 in its position of adjustment. The channel 64 has a flared mouth 89 (FIGS. 5 and 6, and 8 to 10) for receiving the collar 18 of the connector 4. Each comb 48 has an elongate web 91 from which projects row of teeth 88 which are of sufficient number for use with the longest connector 4 that can be accommodated between the blocks 82 and 84. The slots 81 are formed in the webs 91 of the combs 48. Each tooth 88 comprises, as best seen in side view in FIGS. 5 and 6, for example, a first recess 90 for receiving the contact support plate 10 and a termination bar 92 which is shown in detail in FIGS. 13 and 14 and which is described below. Each tooth 88 also has a second recess 94 adjacent to the first, for receiving a respective one of the contacts 8 of the connector 4. Each tooth 88 has, adjacent to the recess 94, a wire guide flange 95, and adjacent to, and sloping away from the flange 95, each web 91 has an inclined wire guide surface 97 extending longitudinally thereof. The recesses 90 and 94, the guide flange 95 and the guide surface 97 are formed in the outer side of the tooth 88, as seen when the comb is in its open, wiring position as will be apparent from FIG. 5, the recess 90 being above the recess 94, the recess 94 being above the flange 95 and the flange 95 being above the guide surface 97. The teeth 88 of each comb 48 define between each pair of adjacent teeth 88, a wire receiving slot 96. On the opposite side of the comb holder 46 to that on which the combs 48 are pivoted, is a cable clamp 98 best seen in FIGS. 1, 2 and 12, having a moveable cable gripping jaw 100 and a fixed cable gripping jaw 102. The jaw 100 can be moved away from the jaw 102 against the action of a spring 104, by rotating an operating handle 106 to release latch means 107 (FIG. 12) and pulling the operating handle 106, to allow an end portion of the cable C to be inserted between the jaws 100 and 102. When the handle 106 is returned, the cable end portion is securely gripped between the jaws 100 and 102. The base 108 of the comb holder 46 is formed with a longitudinally extending opening 110 allowing access to the combs 48 for the wires W of the cable C. The cable clamp 98 is slideably adjustable along the opening 110, lengthwise of the comb holder 46. As best seen in FIGS. 1 and 2, the cable clamp 98 has an elongate nose 112 projecting in the opposite direction to the handle 106. The nose 112 is straddled by a clevis 114 the cross piece of which threadedly receives locking screws 116 (FIG. 12). The nose 112 is slideable in the clevis 114 so that the lengthwise position of the cable clamp 98 can be adjusted and can be fixed in its position of adjustment, by loosening screws 116 and sliding the nose within the clevis and retightening the screws. A guide lug 120 for the connector holder 52 and which fits between the lugs 66, is provided on the base 108 of the holder 46. The combs 48, which may be molded from a plastics material, can be exchanged by removing screws 112 (FIG. 11) securing the blocks 78 and the clevis 55 to the base 108 of comb holders 46. The comb holders 46 can then be removed and the combs therein exchanged. As best seen in FIGS. 13 and 14, the termination bar 92 defines a channel 124 having a base 126 and side walls 128 from each of which projects a row of contact support tines 130. As shown in FIG. 14, the termination bar 92 can be fitted over the contact support plate 10 of the connector 4 which is thereby received in the channel 124, the side walls 128 and the tines 130 serving to support the contacts 8 on the plate 10 when the wires W are being terminated to the contacts 8 as described below.

There is provided in order to facilitate the wiring of the combs 48, a bench stand 132 (FIGS. 3 and 4) comprising a block 134 defining a socket 136 for receiving the comb holder 46 of the tool 2 and having a thumb screw 138 in a side wall 140 for securing the comb holder 46 in the socket 136. A bore 142 opening into the front wall 144 of the block 134 receives a clamping pin 146 of a bench stand clamp 148 having a clamping screw 150, for securing the bench stand 132, and thus the tool 2 to work bench 147.

For wiring the combs 48, the tool 2 is secured in the bench stand 132 as described above and as shown in FIG. 3, with the connector 4, with the termination bar 92 assembled thereto, secured between the blocks 82 and 84 in the connector holder 52 which is in its open angular position remote from the comb holder 46. The combs 48 are in their open, wiring angular positions away from each other with the wire slots 96 of the combs 48 opening upwardly and away from the comb holder 46, and the end portion of the cable C is clamped in the cable clamp 98 with the wires W of the cable end portion projecting through the opening 110 in the base 108 of the comb holder 46 and extending across the combs 48. The operator laces each of these projecting parts of the wires W into a respective wire slot 96 of the combs 48 as will be apparent from FIG. 5. The slots 96 so wired, are those which are opposite to the connector 4 and the connector holder 52. For cross-row termination of the wires W, where the wires are twisted pairs of wires, one wire of each pair is wired to one of the combs 48 at a given location and the other wire of each pair is wired to the other comb 48 at a corresponding location. For in-row termination, one comb 48 is fully wired before and other. In the case of both of these wiring modes, no manipulation of the tool 2 is required and the operator does not need to turn his head in order to wire both of the combs.

Figure 3:
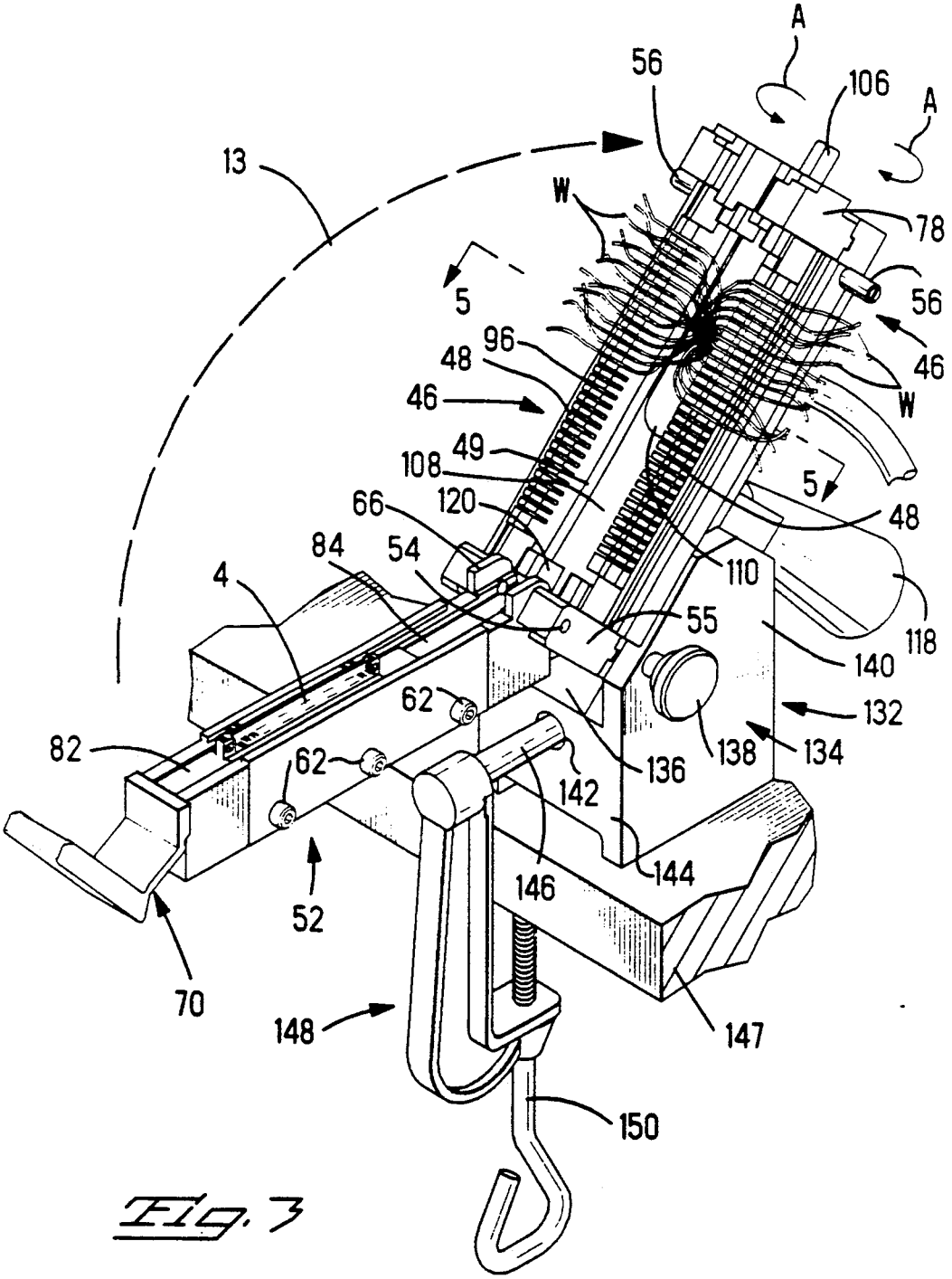
FIG. 3 is an isometric view showing the terminating tool mounted on a bench stand with opposed wire combs of the tool and a connector holder thereof in open wiring positions, wires having been threaded into the combs.
Figure 4:
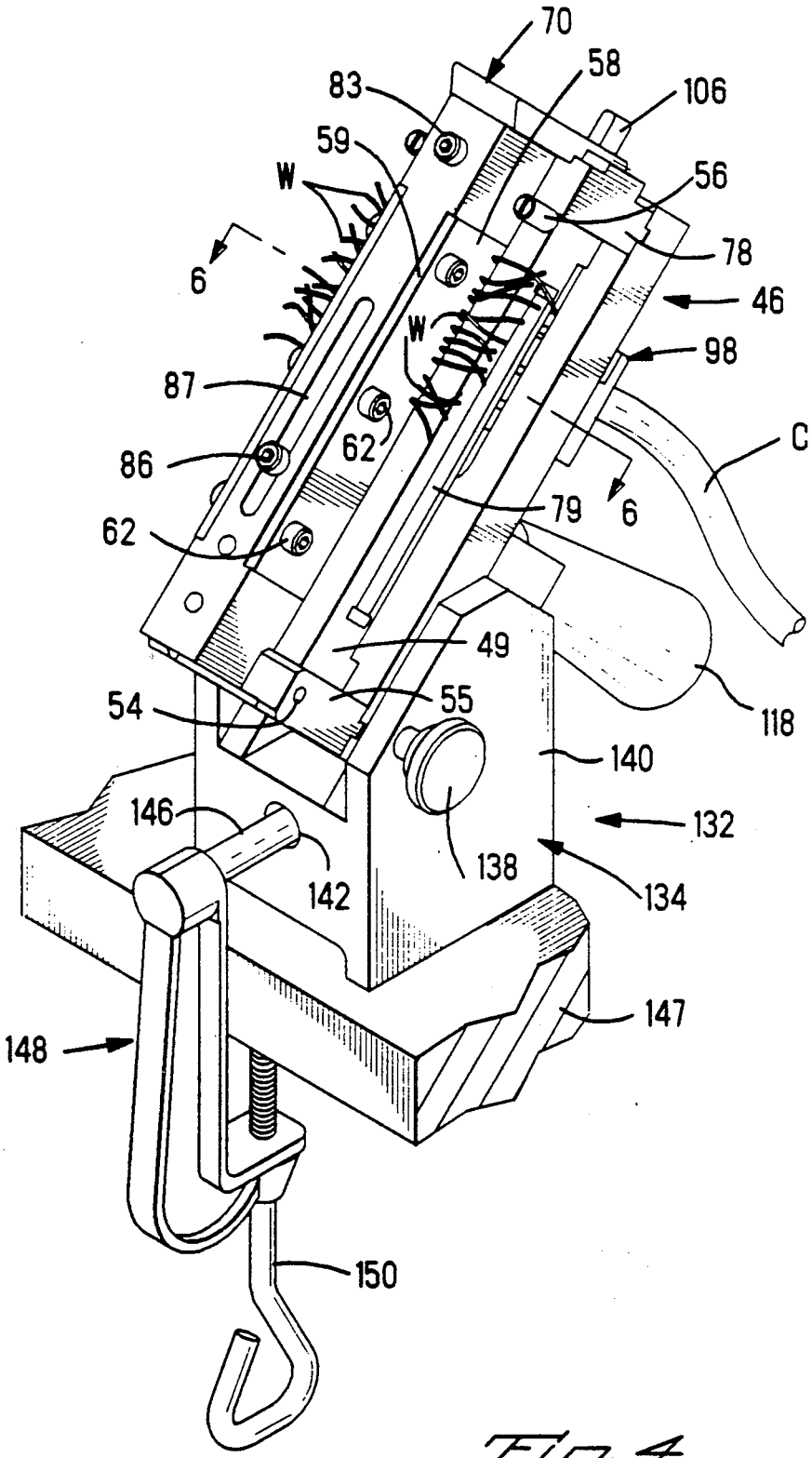
FIG. 4 is similar view to that of FIG. 3 but showing the combs and the connector holder in closed terminating positions for application to the press.
Figure 5:
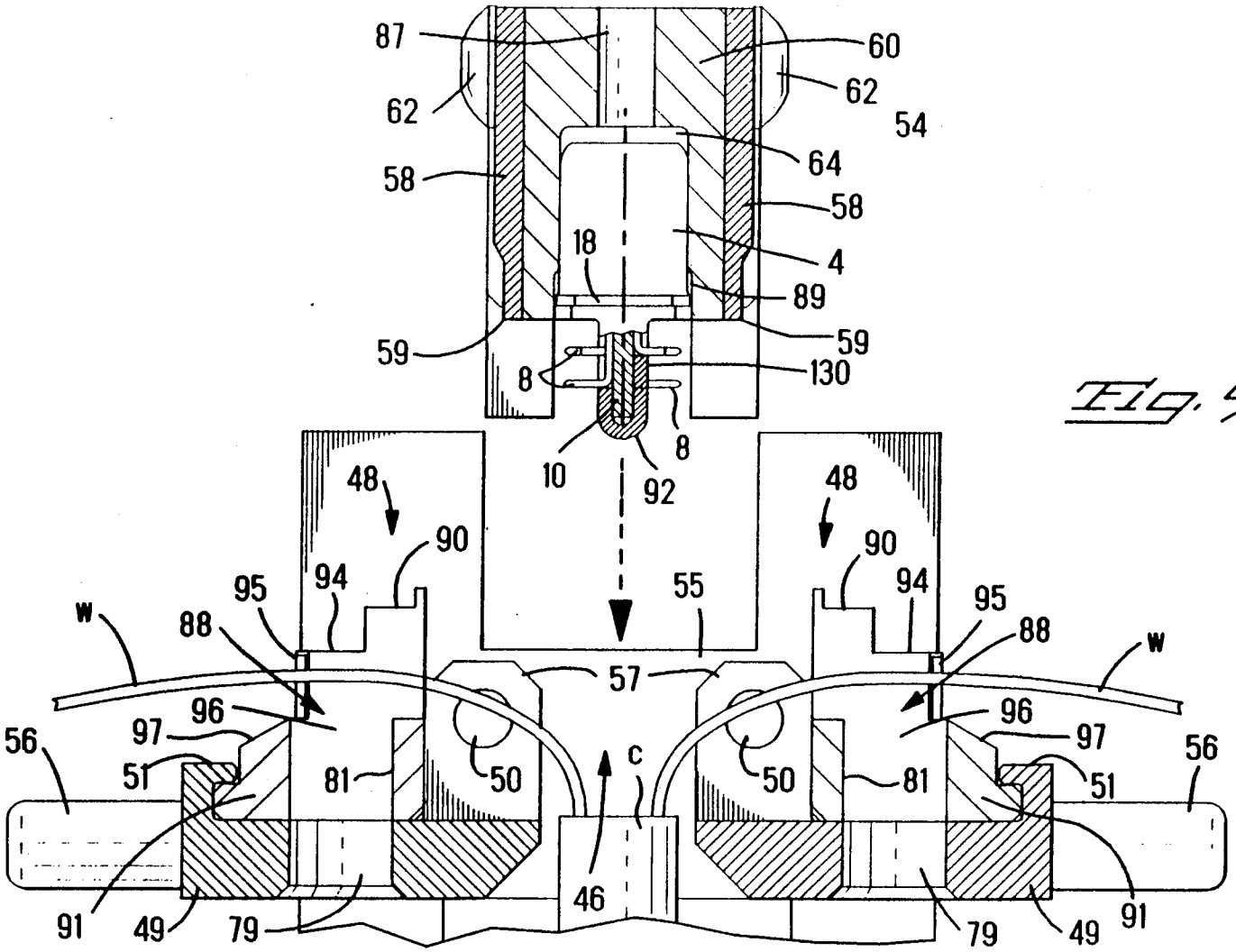
FIG. 5 is a view taken on the lines 5—5 of FIG. 3.

When the wiring operation has been completed, combs 48 are swung towards one another to their closed angular position, in which the wire slots 96 of the two combs open towards each other, by means of the handles 56, as indicated by the arrows A in FIG. 3, and the connector holder 52 is swung to its closed angular position between the combs 48, in the direction of the arrow B in FIG. 3, so that the cross bar 72 of the latch arm 70 engages in the notches 74 of the plates 76, whereby the connector holder 52 is latched down in its closed position as described above. The parts of the tool are now accordingly positioned as shown in FIGS. 4 and 6. As shown in FIG. 6, the termination bar 92 and the contact support plate 10 are received in the recesses 90 of the combs 48, each contact 8 of the connector 4 being received in a respective recess 94 of a respective one of the combs 48. Each wire W in its respective wire slot 96 lies opposite to a respective one of the contacts 8 of the connector 2. Also, each wire W extends from the cable C across a respective wire guide flange 95, across the respective wire shear edge 59 of the connector holder 52, across the adjacent wire guide surface 97, over the edge of the respective comb carrier 49, and out of the tool 2. The slots 79 of the comb carriers 49 are in opposed aligned relationship as are the openings 81 of the two combs 48. The tool 2 is now ready for the wires W to be terminated to the contacts 8 by means of the press 22.

Figure 8:
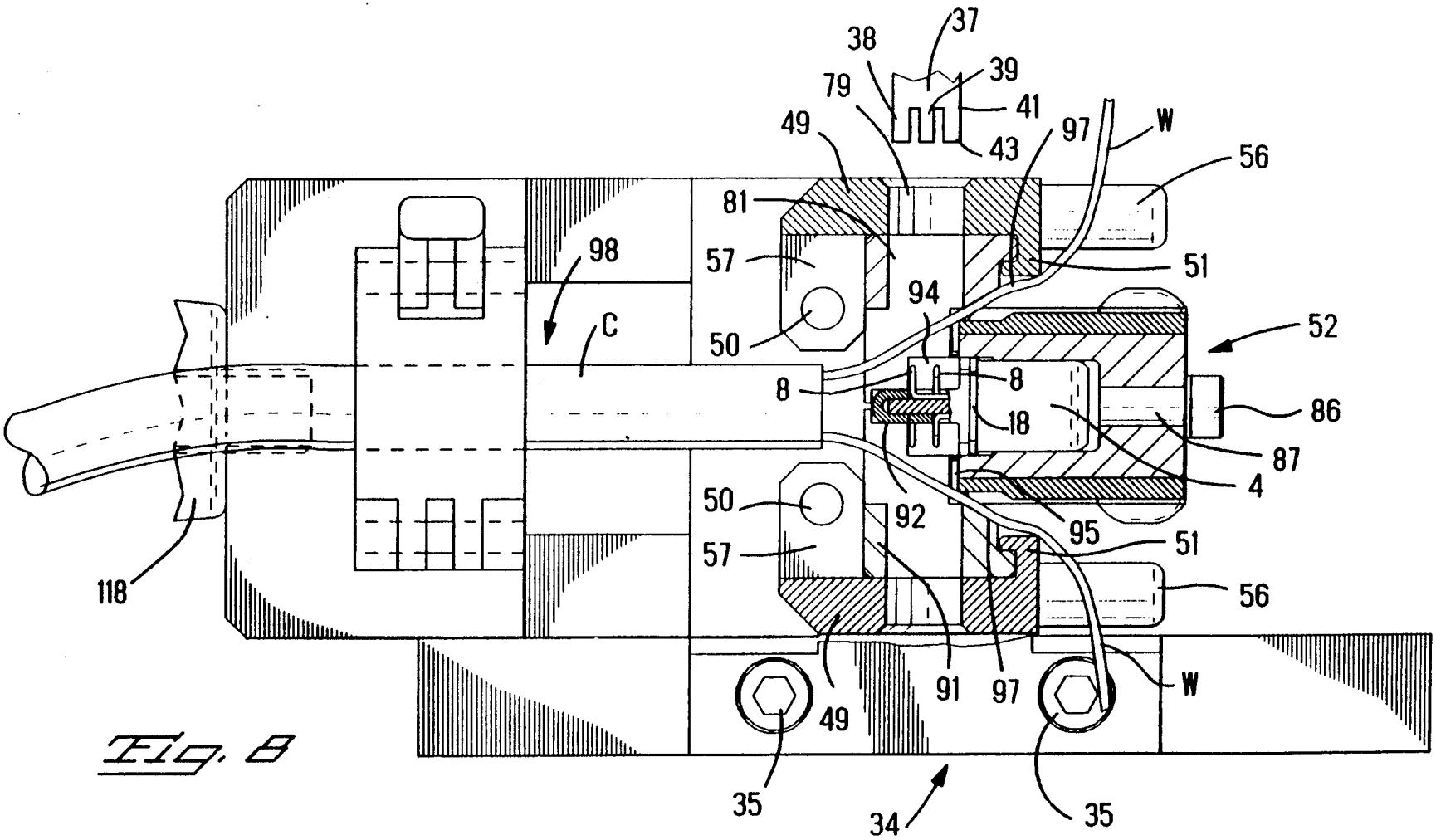
FIG. 8 is a side view shown partly in section, illustrating the tool when mounted on the mounting plate of the press, with a wire trimmer and stuffer plate of the press positioned above the terminating tool.
Figure 9:
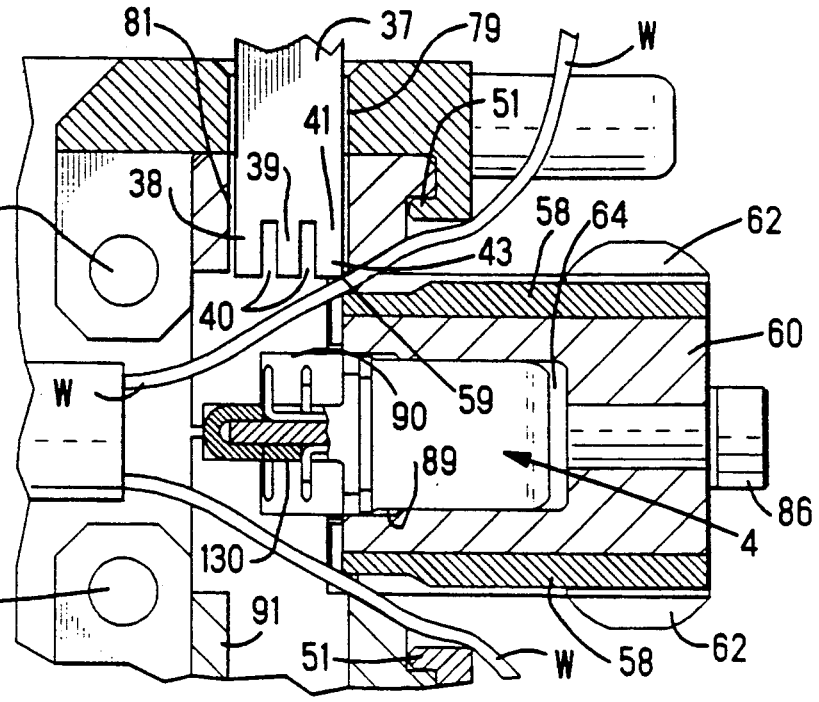
FIG. 9 is an enlarged fragmentary view shown partly in section, illustrating details of FIG. 8 but with the wire trimmer and stuffer plate in an intermediate position about to trim wires on one side of the terminating tool.

The operator grasps the handle 118 of the tool 2 and slides it onto the mounting plate 34 of the press 22 in the manner described above one of the combs 48 uppermost (as shown in FIGS. 2 and 8), so that the mounting rails 36 of the plate 34 are received in the lower channels 32 of the tool 2. The operator then depresses the lever 28 of the press 22 to lower the press ram 26 from its raised position through a working stroke, so that the fingers 37 of the plate 30 enter the slot 79 of the uppermost comb holder 49, each finger 37 then being received in a respective slot 81 of the upper comb (FIG. 9). As operator moves the ram 26 further downwards, through its working stroke, each of the uppermost wires W is trimmed between the shear edge 43 the stuffer member 41 of the respective finger 37, and the shear edge 59 of the uppermost shear plate 58. Each finger 37 then drives a corresponding pair of the trimmed wires W down towards a respective pair of adjacent forward and rear uppermost contacts 8 of the connector 4, these two adjacent contacts 8 being offset from each other longitudinally, as well as forwardly and rearwardly, of the connector 4 as shown in FIGS. 9 and 10. The rearward one of these contacts 8 is received in the recess 40 between the stuffer members 38 and 39 of the finger 37, the forward one of these contacts being received in the recess 40 between the stuffer members 39 and 41 of the finger 37 whereby the trimmed ends of the wires are stuffed into the wire slots of the contacts as shown in FIG. 10. Thus each of the trimmed wires extending from the cable C is stuffed into the wire receiving slot 9 of a respective one of the contacts 8 and is accordingly terminated thereto. The operator now raises the lever 28 thereby returning the ram 26 to its raised position, whereby the fingers 37 are withdrawn from the tool 2. The operator then uses the handle 118 of the tool 2 to withdraw it from the mounting plate 34, rotate the tool 2 to withdraw it from the mounting plate 34, rotates the tool 2 to its opposite orientation in which the unterminated wires W are uppermost, and again slides the tool 2 onto the plate 34 so that the rails 36 are received in the channels 44, the other comb 48 accordingly being uppermost (FIG. 12). The operator again depresses the lever 28 of the press 22 to terminate the now uppermost wires W in the manner described above in respect of the first operation of the press 22.

Figure 15:
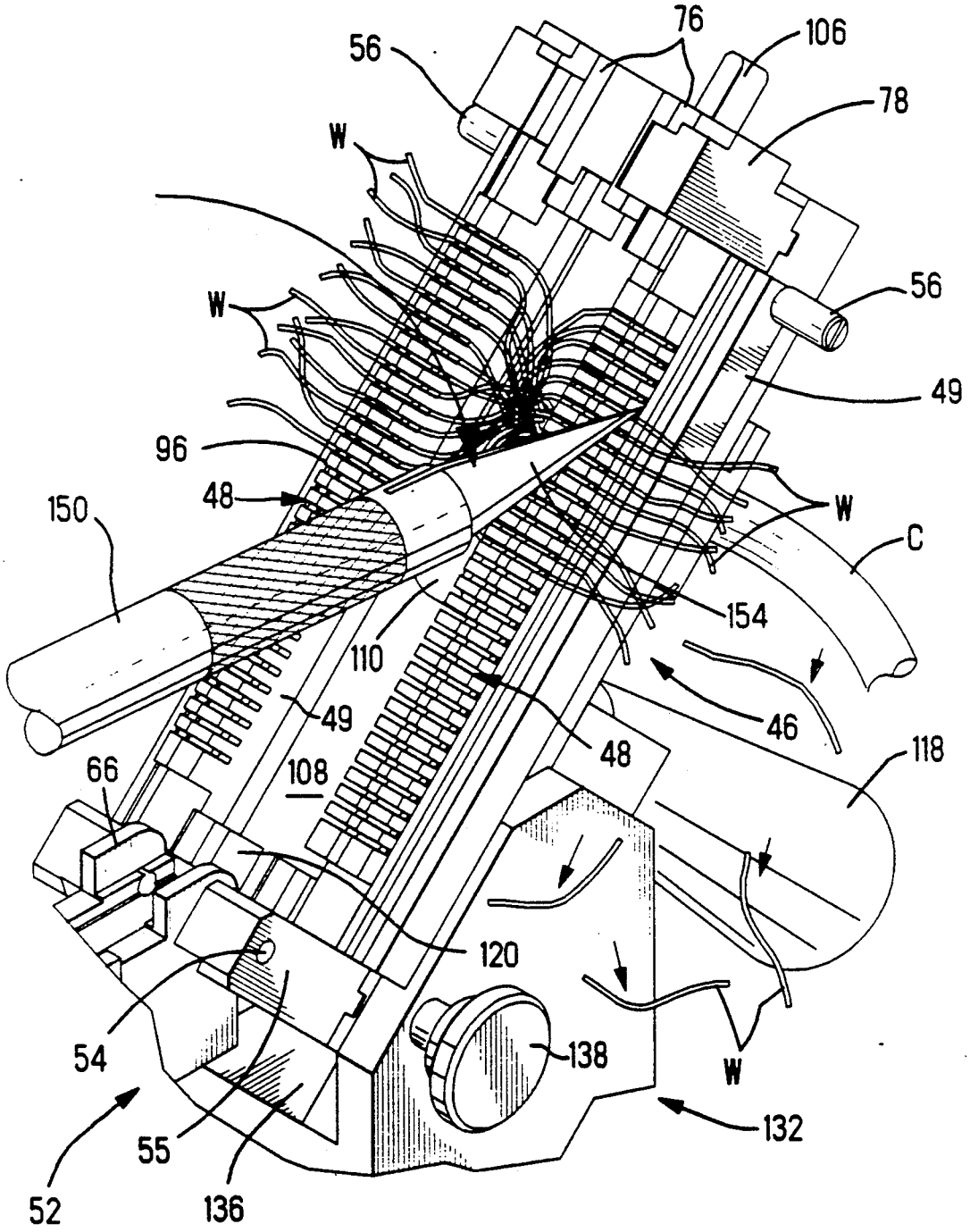
FIG. 15 is an isometric view illustrating a modification of the terminating tool in which the wires are trimmed by means of a knife blade.
Figure 16:
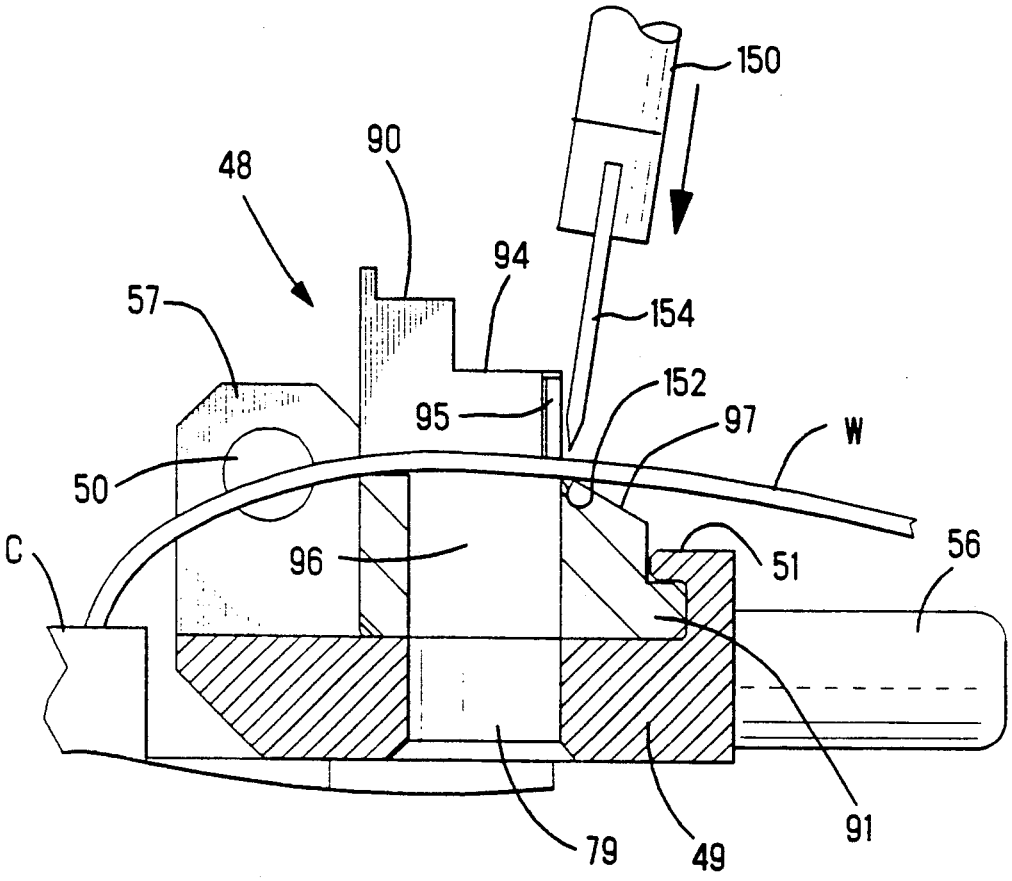
FIG. 16 is an enlarged fragmentary cross sectional view illustrating details of FIG. 15.

A modified version of the terminating tool according to the invention, will now be described with reference to FIGS. 15 and 16 in which parts already described above bear the same reference numerals as those used above. FIG. 15 shows the modified tool positioned in the bench stand 132, both of the combs 48 having been wired in the manner described above and being in their open angular positions. In the case of the modified tool, the wires are not trimmed during the wire terminating operation, but instead, following the wiring of the combs 48, the wires W are trimmed by means of an exacto knife 150. In order to ensure that the wires are cleanly severed at precise locations on each side of the tool and in line with each other, each comb 48 is provided with a longitudinally extending notch 152 in its surface 97 as shown in FIG. 16, just below the wire guiding flange 95, for receiving the tip of the blade 154 of the knife 150.

When daisy chain connections are to be provided between a plurality of connectors 4, the wires, at least of the intermediate connectors of the chain, are not rimmed, the terminating tool 2 or the plate 30 being suitably modified to this end. Each stuffer member 41 may for example be of reduced width so that the wires are not sheared between the members 41 and the edges 59 of the plates 58. Alternatively, for example, the plates 58 could be removed.

I claim:

1. A tool for cooperation with wire insertion fingers for terminating electrical wires to wire receiving contacts projecting in at least one row from each of two opposite sides of a contact support of an electrical connector, the tool comprising:

an elongate wire comb holder having first and second ends;

a pair of elongate wire combs each having teeth defining a row of wire receiving slots extending longitudinally of the comb, the combs being arranged in parallel spaced relationship and being mounted on the comb holder for rotational movement between a comb wiring first angular position in which the wire slots defined by the teeth of the combs open in a direction away from the comb holder to receive wires and a wire terminating second angular position in which the wire slots of one comb open towards those of the other comb; and a connector holder for receiving the connector with the contact support thereof projecting outwardly of the connector holder, the connector holder being moveable with respect to the wire comb holder to insert the contact support of the connector between the wire combs when the wire combs are in their second position, so that each contact on the contact support is aligned with a respective one of the wire slots of the combs for the termination of a wire in said wire slot to said contact by moving a respective one of said wire insertion fingers through said wire slot.

2. A tool as claimed in claim 1, wherein one end of the connector holder is pivotally connected to the first end of the wire comb holder, means being provided for latching the opposite end of the connector holder to the second end of the wire comb holder to retain the contact support of the connector between the wire combs.

3. A tool as claimed in claim 1, wherein the connector holder defines a connector receiving channel and comprises means for adapting the effective length of the channel to the length of the connector.

4. A tool as claim in claim 1, wherein the connector holder defines a connector receiving channel and comprises a wire shear plate secured to the connector holder on each side of the channel and having a shearing edge for cooperation with shearing edges of said wire insertion fingers to trim the wires before the wires are terminated to the contacts of the connector.

5. A tool as claimed in claim 1, wherein the wire comb holder has a base extending between the wire combs, and a cable clamp slideably mounted on a side of the base remote from the wire combs, for adjustment lengthwise of the wire comb holder, the base defining an opening extending longitudinally of the wire comb holder to provide access to the combs for the wires of a multi-wire cable when clamped in the cable clamp.

6. A tool as claimed in claim 5, comprising a clevis projecting from said side of the base remote from the wire combs, and having a tapped opening therethrough, a handel for manipulating the tool, a screw projecting from the clevis and threadingly secured to the base, and a nose on the cable clamp extending slideably through the clevis, the handle being rotatable to cause said screw to engage said nose to secure the cable clamp in a desired position of adjustment lengthwise of the wire comb holder.

7. A tool as claimed in claim 1, wherein each wire comb defines a longitudinally extending notch on the side of the wire comb remote from the other of the wire combs, for receiving a knife blade for trimming wires received in the wire slots of the combs in said first angular positions of the combs.

8. A tool as claimed in claim 1, wherein each comb is secured in an elongate comb carrier having first and second ends each pivotally attached to the comb holder, each comb holder having a handle thereon for moving the combs between their first and second angular positions.

9. A tool as claimed in claim 1, wherein the teeth of the combs have recesses for receiving the contact support of the connector and the contact thereof, in the second angular position of the combs, webs connecting the teeth of the combs having openings therein for receiving respective ones of the wire insertion fingers, in the second position of the combs.

10. A tool as claimed in claim 9, wherein each comb is secured in a comb carrier pivotally attached to the comb holder to enable movement of the combs between their first and their second angular positions, each comb carrier having a through slot aligned with the openings of the comb therein for receiving said wire insertion fingers.

11. A tool as claimed in claim 9, wherein each opening in the web of each comb is dimensioned to receive a wire insertion finger for terminating wires to forward and rear of said contacts on the contact support of the connector.

12. A tool as claimed in claim 1, wherein the connector holder comprises wire shear edges for cooperation with corresponding wire shear edges on the wire insertion fingers when the combs are in their second angular position, for trimming the wires before they are terminated to the contacts of the connector, the teeth of the combs and webs thereof connecting the teeth of the combs having wire guide surfaces for guiding the wires between the shear edges of the connector holder and the wire insertion fingers.

13. A tool as claimed in claim 1, comprising a clevis on said first end of the comb holder, one end of the connector holder being pivotally mounted in said clevis, latch block means at the second end of the comb holder, means on the other end of the connector holder for latching such end to the latch block means, and a pair of comb carriers, each comb being exchangeably mounted in a respective one of said comb carriers and each comb carrier being pivotally connected at one end thereof to said clevis and at the other end thereof to said latch block means.

14. A tool for use in terminating electrical wires to rows of electrical contacts upstanding from opposite faces of an electrical connector, each contact having a wire receiving slot opening in a direction away from the connector, the tool comprising; a wire comb holder; a pair of opposed parallel wire combs mounted on the wire comb holder for rotational movement between an open, comb wiring angular position and a closed, wire terminating angular position, each comb defining a row of through access slots dimensioned to receive respective wire stuffing means in the wire terminating angular position of the wire combs; and a connector holder for insertion between the wire combs when in their closed wire terminating position, to locate the connector therebetween, whereby said wire stuffing means can be inserted through each wire comb by way of said access slots to stuff wires loaded into the wire combs in their open position, into the wire receiving slots of the contacts.

15. A tool as claimed in claim 14, wherein each comb defines a row of wire receiving slots, each wire receiving slot of one comb being aligned with a wire receiving slot of the other comb, the comb holder having an elongate base and the combs extending along opposite sides thereof, the wire receiving slots of the combs opening in a direction away from said base in the opening comb wiring angular position of the combs and opening towards one another in said terminating angular position of the combs.

16. A tool as claimed in claim 15, wherein the connector holder is pivotally attached to the wire comb holder for movement between a first angular position remote from the wire comb holder to allow wires to be laced into the wire receiving slots of the combs in said open wiring position thereof, and in second position in which a connector in the connector holder is located between the wire combs when in their wire terminating position.

17. A tool as claimed in claim 15, where the base of the wire comb holder defines a wire access through opening extending longitudinally thereof and a cable clamp on a side of the base remote from the wire combs, the cable clamp being adjustable longitudinally of said opening.

18. A tool as claimed in claim 14, wherein the connector holder is provided with means for cooperation with said wire stuffer means, for trimming the wires in the wire terminating angular position of the wire combs.

19. A tool as claimed in claim 14, wherein the wire combs are provided with notches each for cooperation with a knife blade for trimming the wires ins aid wiring angular position of the wire combs.

20. A tool as claimed in claim 14, wherein the wire comb holder is provided with means for cooperation with means on a mounting plate of a press for locating the tool on the mounting plate in alternative first and second orientations, one comb being uppermost in the first orientation and the other being uppermost in the second orientation.

* * * * *